US008028480B2

(12) United States Patent
Loeks

(10) Patent No.: US 8,028,480 B2
(45) Date of Patent: Oct. 4, 2011

(54) MODULAR LOG BUILDING CONSTRUCTION

(76) Inventor: David A. Loeks, Whitehorse (CA)

( * ) Notice: Subject to any disclaimer, the term of this patent is extended or adjusted under 35 U.S.C. 154(b) by 110 days.

(21) Appl. No.: 12/372,611

(22) Filed: Feb. 17, 2009

(65) Prior Publication Data

US 2009/0205274 A1 Aug. 20, 2009

(30) Foreign Application Priority Data

Feb. 19, 2008 (CA) ..... 2622773

(51) Int. Cl.
*E04B 1/10* (2006.01)

(52) U.S. Cl. ..... 52/233; 52/586.1

(58) Field of Classification Search ..... 52/233, 52/404.1, 586.1, 585.1, 587.1, 582.1
See application file for complete search history.

(56) References Cited

U.S. PATENT DOCUMENTS

| | | | | | |
|---|---|---|---|---|---|
| 2,403,934 | A * | 7/1946 | Lindstrom | 52/233 |
| 4,250,677 | A * | 2/1981 | Yablonski | 52/233 |
| 4,320,610 | A * | 3/1982 | Rupp | 52/233 |
| 4,485,598 | A * | 12/1984 | Guardiani | 52/79.1 |
| 4,503,647 | A * | 3/1985 | Post | 52/233 |
| 4,742,657 | A * | 5/1988 | Veech | 52/233 |
| 4,840,003 | A * | 6/1989 | Lucas et al. | 52/233 |
| 5,265,390 | A * | 11/1993 | Tanner | 52/233 |
| 5,787,661 | A * | 8/1998 | Sharp | 52/233 |
| 5,799,452 | A * | 9/1998 | Moore | 52/233 |
| 5,839,214 | A * | 11/1998 | Peterson | 38/102.4 |
| 6,000,177 | A * | 12/1999 | Davidson | 52/233 |
| 6,363,672 | B1 * | 4/2002 | Baker | 52/233 |
| 6,385,929 | B1 * | 5/2002 | Englehart | 52/233 |
| 6,422,292 | B1 * | 7/2002 | Berry et al. | 160/374.1 |
| 6,427,414 | B1 * | 8/2002 | Wing | 52/590.1 |
| 7,117,647 | B2 * | 10/2006 | Clarke | 52/233 |
| 7,313,890 | B2 * | 1/2008 | Clarke | 52/233 |
| 7,594,367 | B2 * | 9/2009 | Clarke | 52/233 |
| 7,594,370 | B2 * | 9/2009 | Clarke | 52/586.1 |
| 2006/0288656 | A1 * | 12/2006 | Clarke | 52/233 |
| 2007/0294967 | A1 * | 12/2007 | Posselt | 52/233 |

FOREIGN PATENT DOCUMENTS

| | | |
|---|---|---|
| CA | 1242558 | 10/1988 |
| CA | 2206290 | 12/1998 |
| CA | 2609404 | 2/2009 |

* cited by examiner

*Primary Examiner* — Richard E. Chilcot, Jr.
*Assistant Examiner* — Beth Stephan
(74) *Attorney, Agent, or Firm* — Oyen Wiggs Green & Mutala LLP

(57) ABSTRACT

This application describes a wall construction and method of making the same in generally a Piece-en-piece mode. A vertical mortise is provided in adjacent vertical timber members and vertical mortises are cut into the end faces of horizontal timber members expected to be placed between adjacent vertical member. When the horizontal timber members are in place the vertical mortises align and wooden or metal splines can be inserted into the mortises thus securing the horizontal members laterally while still allowing them to move vertically to account for, for example, shrinkage in the wood. By substituting a mortise for a tenon, this invention reduces manufacturing costs and reduces assembly time and costs, as each horizontal timber can be set directly into place without lifting it to the top of the upright timber members.

23 Claims, 4 Drawing Sheets

MODULAR LOG BUILDING CONSTRUCTION

TECHNICAL FIELD

This invention relates to the construction of log cabins, log buildings, and solid timber buildings and the like.

BACKGROUND

Solid wood buildings, made of logs or of squared timbers have been in use for centuries. A particular construction of solid wood building, commonly called "piece-en-piece" employs horizontal solid logs or horizontal squared timber members (or alternatively called herein "log members") stacked vertically between upright timber members. The upper and lower elongated surfaces of each horizontal timber member are flattened. The main advantages of "piece-en-piece" construction is that a) it employs relatively short timbers which are easier to handle than wall-length logs, and b) short timbers of suitable cross-sectional dimensions are more abundant than long timbers of the same cross-sectional dimensions, and c) it requires relatively lower costs in labor, heavy equipment, and specialized skills than many other forms of log construction.

As currently practiced, piece-en-piece log construction requires that vertical tenons be fashioned into the ends of the horizontal log members that comprise a wall section. These tenons engage vertical mortises, or continuous grooves, that are cut into the faces of the upright timbers adjacent to the ends of the horizontal timber members. The mortise-and-tenon construction fulfils two functions: it secures the vertically stacked horizontal timbers from lateral movement, and it permits each horizontal log member to move vertically relative to the upright timbers as needed by shrinkage or settling forces. To set a horizontal log into place, it must be raised to the full height of the upright timber members in order to insert the tenons into the mortises of the upright timbers. Once the tenons are engaged into the mortises, the horizontal timber member is dropped down into position.

It was observed by the inventor that an opportunity exists to reduce manufacturing costs and labor costs for piece-en-piece log construction by means of an innovation in design.

The herein discussed examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

This invention reduces manufacturing costs and reduces labor costs for piece-en-piece log construction. Instead of fashioning vertical tenons into the ends of the horizontal log members, a vertical mortise, or groove is cut into each end. When the mortise in a horizontal log member is aligned with the vertical mortise in an upright timber member, the log is secured by inserting a spline into the matching grooves on the adjacent surfaces. Each spline extends below the lower surface of the horizontal log it is engaging, and into the mortise of the adjacent log below. The horizontal timber members are free to move vertically in response to shrinkage or settling forces. This method of securing the horizontal log members by means of matching mortises and splines is a reduction in manufacturing costs over fashioning tenons in the horizontal logs, and a mill need fashion but 3 components to build a wall or even a building: sills/tie beams, upright members, and horizontal member.

When assembling a wall, each horizontal log member is lifted no higher than is needed to insert it directly into place on top of a previously-laid log member. It is not necessary to lift each log to the full height of the upright timber members, as is the case with the typical mortise-and-tenon system. By these means, labor costs in assembling a wall are reduced, and the time of assembly is similarly reduced. As each log section is relatively short, two strong individuals can handle each piece, and no heavy equipment is needed to assemble the structure.

One or more strips of expanding weatherstrip insulation may be laid between adjacent upper and lower surfaces of the vertically stacked horizontal timber members. The elongated edges and the vertical edges of the horizontal timber members may be chamfered to accept a continuous bead of caulking or chinking sealant. The vertical edges of the upright timber members may be similarly chamfered to accept a continuous bead of caulking or chinking sealant.

Two upright timber members separated by vertically stacked horizontal timber members define a section of wall. A wall section is secured by attaching the lower distal end of each upright timber member to horizontal sill timbers which are attached to a foundation or floor construction. The tops of the upright timber members in a wall section are attached to each other with a tie beam, a horizontal timber member whose ends rest on the tops of each upright timber member and are attached to them. A succession of wall sections may be given lateral stability by fastening horizontal, a wooden top plate or doubled wooden top plates to the top of the tie beams so that they overlap the joints of adjacent tie beams.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive. The Figures show several perspective views of a wall section or a portion of a wall section, showing details of upright corner timbers and upright wall section timbers, horizontal timbers, mortises and splines, sill logs, tie beam logs, and top plates.

In drawings which illustrate preferred embodiments only of the present invention.

Figure 1:
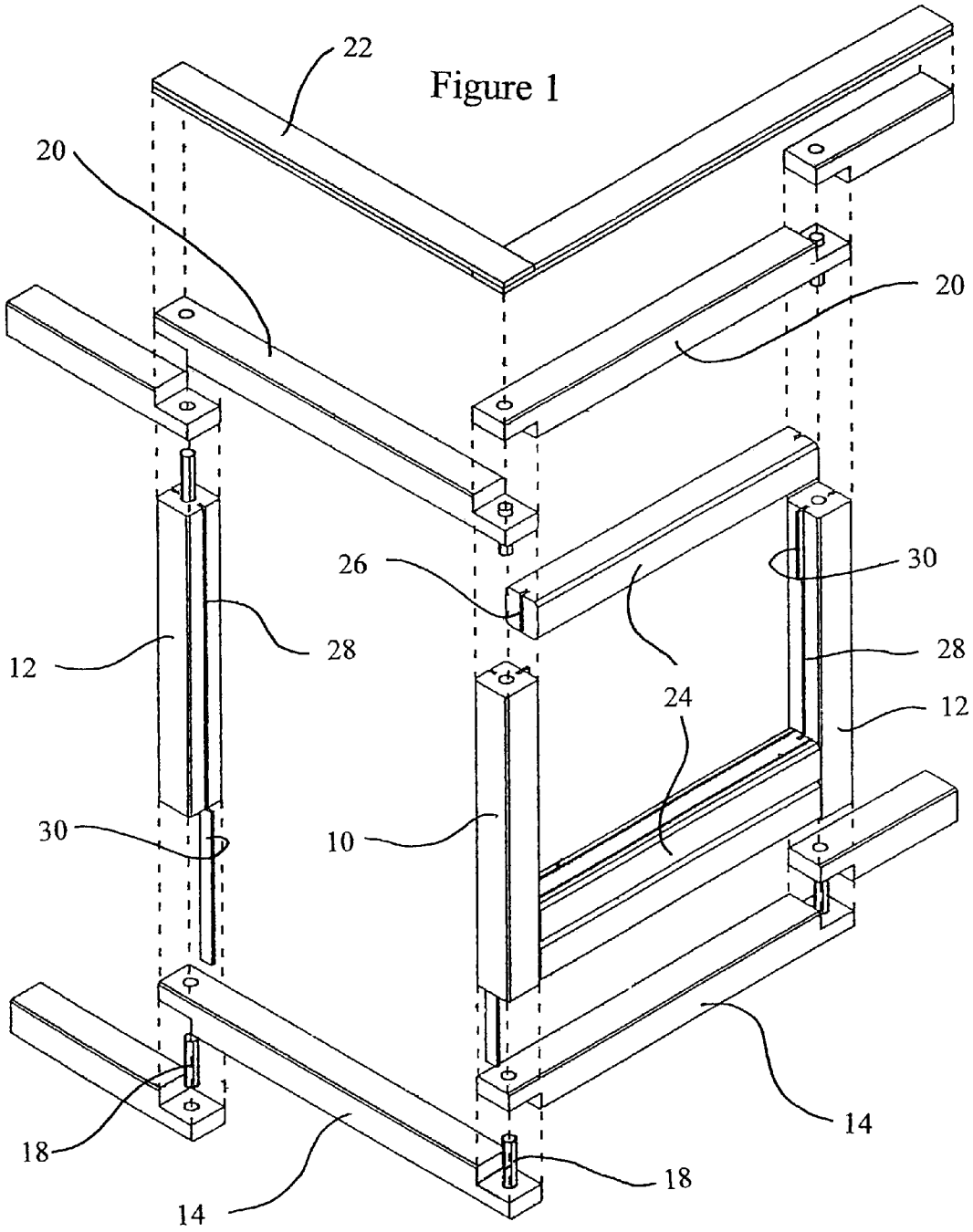
FIG. 1 is an expanded view illustrating how all components of a wall construction of the present invention fit together.
Figure 6:
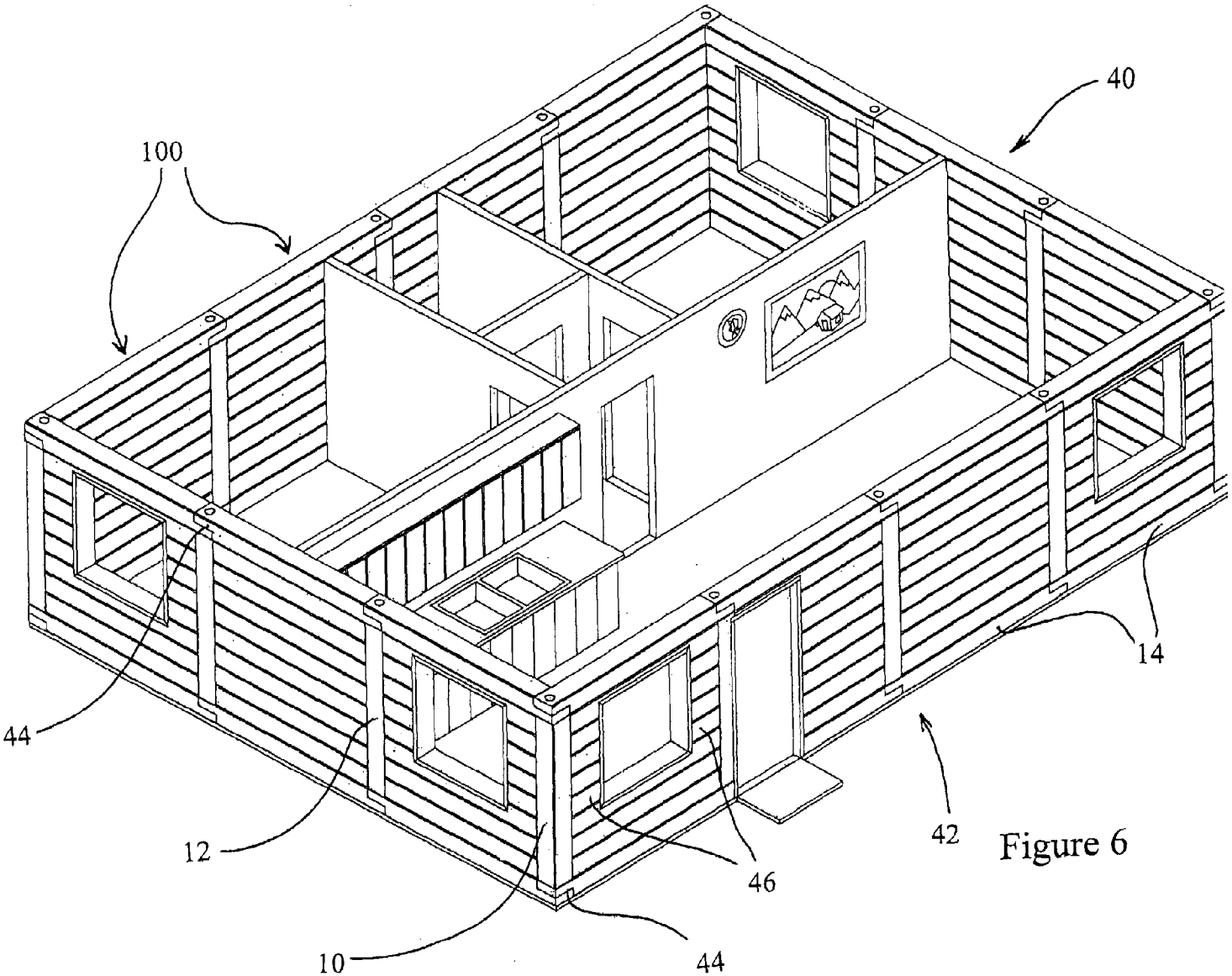
FIG. 6 shows a perspective view of a sample log building structure showing how multiple wall sections can be assembled into a long wall, and how interlocking sill logs and interlocking tie beams can describe a 360° structure through four 90° corners. The top plates are omitted from FIG. 6 for sake of clarity.

In both FIG. 1 and FIG. 6, the horizontal and vertical timber members are illustrated as square in cross-section. It will be appreciated that either or both can alternately have naturally rounded, or artificially rounded vertical surfaces where these surfaces face the outside or the interior of the building. Any dimensions cited in this application are for illustrative purposes; the invention can of course employ other dimensions.

DETAILED DESCRIPTION OF THE PREFERRED EMBODIMENT OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

FIG. 1 illustrates how each of the components of the present invention fit together to make up the construction of a wall section 100. The upright vertical timber members that define a wall section 100 may be corner posts 10 or spacing posts 12. These posts preferably rest on sill timbers 14 which are placed horizontally on a foundation 16 (FIG. 3), footing, or secure floor joists. Each sill timber is notched on its distal ends so that half-lap joints may be created between adjacent sill timbers. The sill timber joints may be linear or at right angles (both shown in FIG. 1). Each sill timber joint is preferably secured with a vertically placed wood dowel 18 or metal pin, which secures the upper and lower ends to one another, and which may extend vertically into the upright member 10, 12.

Tie beams 20 are fashioned in a similar or even identical manner as sill timbers 14, with notches creating half-lap joints with adjacent tie beams. Each tie beam joint rests on top of an upright timber member 10, 12. Each tie beam joint is preferably secured with a wooden dowel 18 or metal pin that extends into the distal end of the upright timber member on which it rests. One or more (preferably two) top plates 22 are secured to top surfaces of the tie beams. On walls that are comprised of a succession of wall sections, the top plates 22 will preferably span the entire length of the wall, or at least, the joints of each plate 22 will occur in the middle of a tie beam, and not over its joint. This strengthens the structure. The joints of upper and lower top plates will preferably be separated by the width of at least one wall section.

Horizontal timber members 24 are stacked vertically between upright timber members 10, 12. Their upper and lower bearing surfaces are preferably flat. The lowermost horizontal timber member 24 is preferably secured directly to the sill log member 14 on which it rests. A weather seal may be accomplished by placing two parallel rows of expanding foam weather strip lengthwise along the upper surface of each horizontal timber member. A vertical mortise 26 is cut into each distal end of each horizontal timber member 24. A vertical mortise 28 is cut into the vertical surface of each upright timber member where it faces the mortised distal end of a horizontal timber member 24.

A horizontal timber member 24 is set directly in place so that its mortises 26 face the mortises 28 on the adjacent upright timber members 10, 12. The horizontal timber member 24 is then preferably secured by inserting a wooden or metal spline 30 into the facing mortises, thereby generally locking horizontal timber member 24 laterally in place. Spline 30 may extend a short distance past the lower surface of the horizontal timber member 24 into the mortise of the horizontal timber 24 immediately below, securing those two members 24 together. Successive horizontal members 24 may be placed similarly, until a requisite height is obtained.

The longitudinal edges of the horizontal timbers may be chamfered ahead of time or after placement to accept a bead of caulking or synthetic chinking compound.

Figure 2:
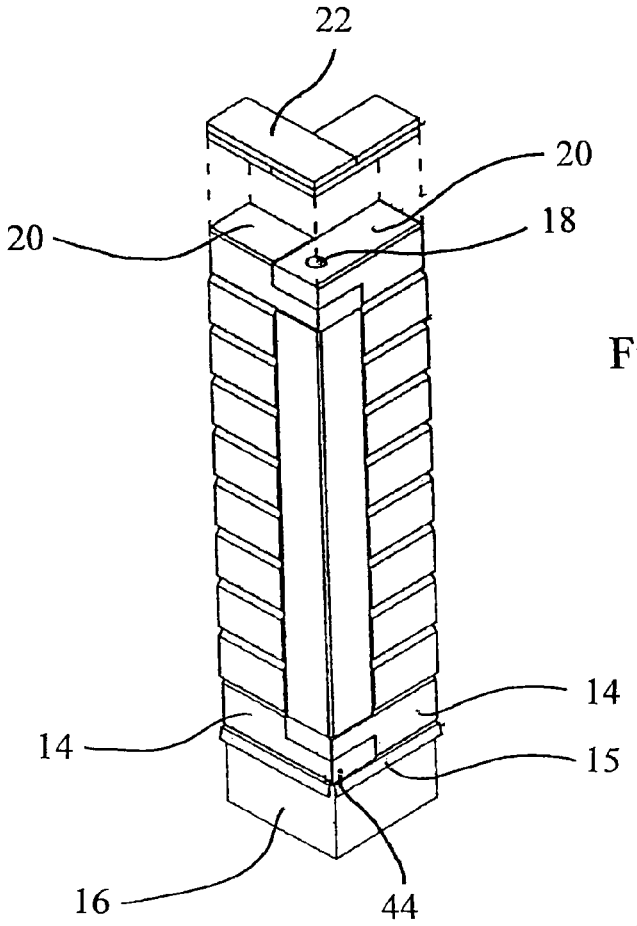
FIG. 2 presents a detailed view of an upright corner with top-plates.

FIG. 2 illustrates in detail how wall sections adjoin to form a completed corner. A vertical timber member 10 which has been fashioned into a corner timber by having mortises on adjacent faces rather than on opposing faces rests on sill timbers 14 which adjoin to form a right-angle half-lap joint. This joint is secured by a wooden dowel or a metal pin (hidden in this figure) that extends into the upright timber member 10. The sill timbers 14 rest directly on a foundation 16 or on floor joists set on a foundation. Galvanized wall flashing 15 may be set between the sill timber 14 and the foundation 16 or floor to shed moisture.

Tie beams 20 rest on top of the upright corner timber 10, their distal ends having been notched to create a right-angle half-lap joint. This joint is secured by a wooden dowel 18 or a metal pin which preferably extends into the top of the upright corner timber 10 on which the joint rests. A plurality of horizontal timber members 24 are stacked vertically on the sill timbers 14. The mortises at their distal ends are aligned with the mortise on the adjoining face of the upright corner timber 10 and are secured with splines as illustrated in FIG. 1. Double top plates 22 are fastened to the upper surfaces of the tie beams 20 to provide additional rigidity to a succession of wall sections.

Figure 3:
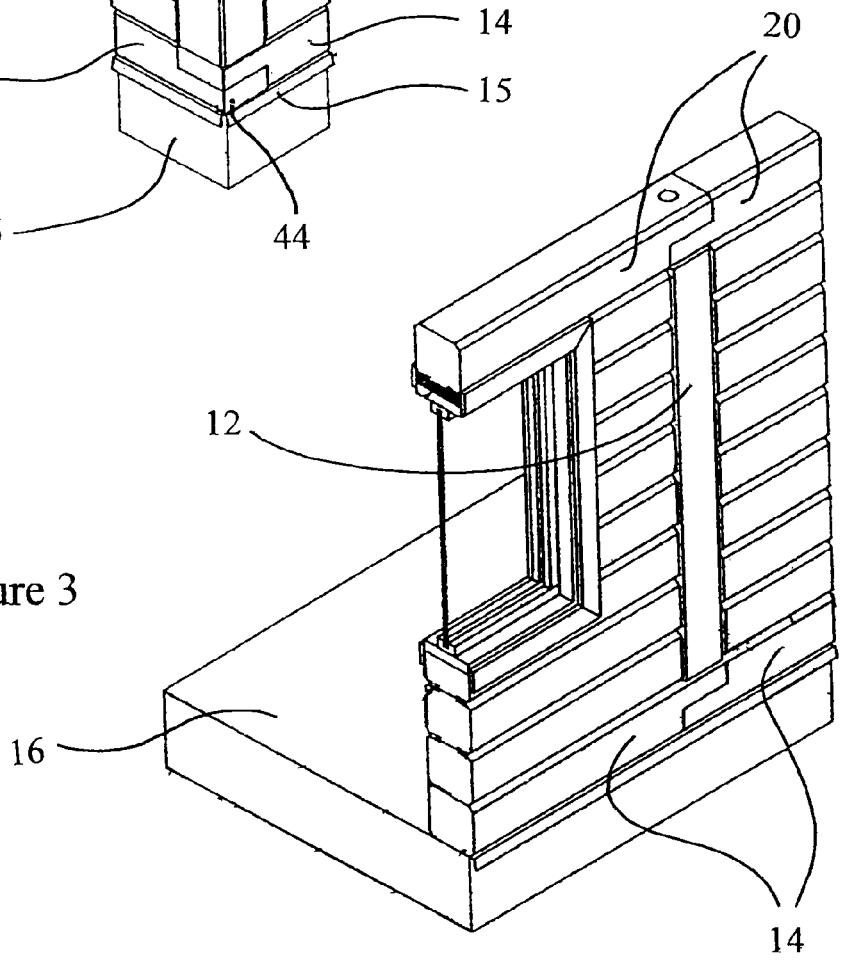
FIG. 3 illustrates how an upright timber serves as a spacing post to join successive wall sections.

FIG. 3 shows how an upright timber member 12 mortised on opposite vertical faces functions as a spacing post to join adjacent wall sections linearly or in-line. The upright timber member 12 rests on the half-lap joint of sill timbers 14 which rest on and are secured to a foundation 16 or floor. The half-lap sill timber joint is secured with a wooden dowel or a metal pin (hidden in this view) that extends into the upright timber member 12. Tie beams 20 rest on top of the upright timber member, and extend to the next adjacent upright timber member. The ends of each tie beam 20 are notched to create a half-lap joint with the adjoining tie beam. Each tie beam joint rests on top of an upright timber member 12 and each joint is secured with a wooden dowel or metal pin (hidden in this view) that preferably extends into the upright timber member below it.

Horizontal timber members 24 are stacked vertically on top of the sill timbers 14. The distal ends of each horizontal timber member 24 have a vertical mortise (notated 26 in FIG. 1). The vertical mortises on distal ends of each horizontal timber member are aligned with the continuous vertical mortises (notated 28 in FIG. 1) on adjacent upright timber members 12 and are secured with a spline (notated 30 in FIG. 1) inserted into the matching facing mortises. The spline preferably extends a short distance into the mortise of the horizontal timber member immediately below. The horizontal timber members 24 are preferably just long enough to fill the space between upright timber members 12 without binding, so that they can move vertically in response to shrinkage or settling forces. The top plates are not illustrated in this Figure but would preferably be added.

Figure 4:
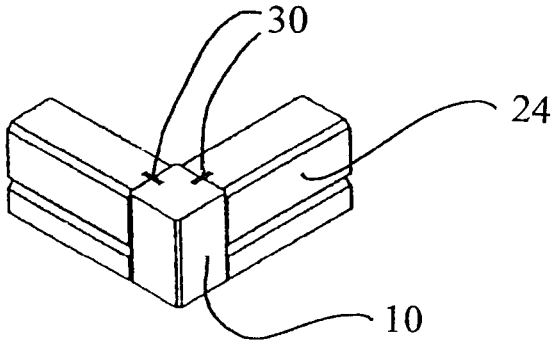
FIG. 4 shows a perspective top view of how mortises, splines, upright corner timbers, and horizontal timbers fit together.

FIG. 4 is a perspective, top view of a partial corner assembly. An upright timber member forms a corner post 10 by having a vertical mortise cut preferably along the centerline of adjacent upright faces. Horizontal timber members 24 are stacked vertically in alignment with the vertical mortised faces of the corner post. The distal end of each horizontal timber member has a vertical mortise cut along its centerline. It is aligned with the vertical mortise on the corner post and is secured with a spline 30. The top plates are not illustrated.

Figure 5:
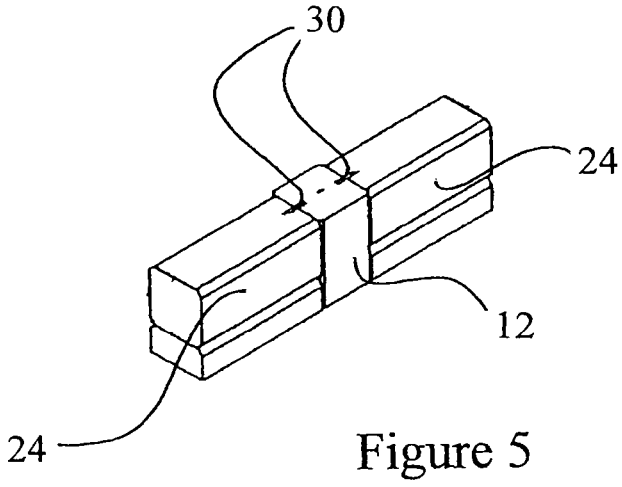
FIG. 5 shows a perspective top view of how an upright timber member joins the horizontal timber members of adjacent wall sections by means of mortises and splines.

FIG. 5 is a perspective, top view of a portion of an upright timber member fashioned as a spacing post 12. The upright timber member 12 has a continuous vertical mortise cut preferably along the centerline of each opposite vertical face. Horizontal timber members 24 are stacked vertically in alignment with the vertical mortised faces of the spacing post 12. The distal end of each horizontal timber member has a vertical mortise cut along its centerline. It is aligned with the vertical mortise on the spacing post and is secured with a spline 30.

FIG. 6 shows a perspective view of a sample log building structure 40 showing how multiple wall sections 100 can be assembled into a long wall, and how interlocking sill logs and interlocking tie beams can describe 360° through four 90° corners. The top plates previously described are omitted from FIG. 6 for sake of clarity. Typical dimensions for each of the wall sections which make up the individual walls might be 8', for a total building length of roughly 32', and width of 24'. The log structure 40 rests on a secure foundation, footings, or floor.

To construct the structure 40, sill timbers 14 are usually first secured to the foundation, footings, or floor, establishing the perimeter of the building. As previously described, the distal ends of each sill timber are notched on opposite surfaces to provide for a half-lap joint 44 with adjoining sill timbers 14. A half-lap sill timber joint 44 may form a right-angle at corners, or may be in-line where it is in the middle of a wall 42. Again as previously described, each joint 44 is secured by a vertical wooden dowel or metal pin that extends through the joint and projects above it.

Upright timber members 10, 12 are positioned over each half-lap sill timber joint 44. Each upright timber 10, 12 has a cavity in the center of each distal end, preferably aligned with its longitudinal axis. The cavity in the lower distal end of the upright timber member 10, 12 accepts the dowel or metal pin projecting from the sill joint 44. Upright timber members 10 positioned over corners are mortised (preferably pre-mortised) on adjacent interior vertical faces (see FIGS. 1 and 4). Upright timber members 12 positioned over in-line sill timber joints 44 are mortised on opposite vertical faces (see FIGS. 1 and 5). Each upright timber member 10, 12 may be temporarily braced in a vertical position. A wooden dowel or metal pin is inserted into a vertical cavity (preferably generally aligned with the longitudinal axis of the timber member) in the top distal end of each upright timber member.

Horizontal timber members 24 are then stacked vertically on the sill logs 14. First, the lowermost timber 24 is secured to the sill log. Then, another timber 24 is placed on top of lowermost timber 24, and others are added in a similar manner. Each horizontal timber 24 has a vertical mortise on the centerline of each distal end. The mortises on each horizontal timber member are aligned with the vertical mortises of the adjacent upright timber members. These are secured with splines in the facing mortises as described in FIGS. 4 and 5.

When the required number of horizontal timber members have been positioned and secured with splines, tie beams 20 are positioned over each upright timber member 10, 12. The distal ends of each tie beam 20 are notched on opposite surfaces to provide for a half-lap joint 44 with adjoining tie beams. A half-lap tie beam joint 44 may form a right-angle at corners, or may be in-line where it is in the middle of a wall. The half-lap notch in each of the distal ends of each tie beam has a vertical hole centered in it to receive the dowel or metal pin projecting from the upright timber member.

When all tie beams 20 are secured in place, preferably two layers of top plates (not illustrated in FIG. 6) are secured to the upper surface of the tie beams 20. Ideally, each top plate is long enough to span the wall on which it is fastened. Where the top plates do not span an entire wall, the joints of adjacent top plates should be positioned between tie beam joints 44. Ideally, the joints of the upper course of top plates should be in different wall sections than the joints of the lower course of top plates. When both courses of top plates have been secured, the temporary braces may be removed from the upright timber members 10, 12.

If settling or shrinkage occurs in the horizontal timber members 24, each horizontal timber member can move downwardly by gravity unimpeded by the mortise-and-spline system. In this instance, a gap will appear between the upper surface of the topmost horizontal timber member 24 in a wall section 100 and the lower surface of the tie beam above it. This gap can be easily filled with expandable foam weather sealing or the like and recaulked.

Traditional openings such as doors and windows can be added to the walls 42 either by cutting the timber members 24 after they have been put into place, or that shorter timber members 46 can be utilized to take into account the addition of a window, for example, as shown in FIG. 6.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A modular wall section for a building comprising:

a) a first sill timber having distal ends, each distal end comprising a notch to provide a half-lap joint with an adjacent sill timber, each distal end having an aperture formed therethrough for receiving a vertically placed securing member;

b) first and second upright timber members spaced apart and extending upwardly from said first sill timber and coupled to said first sill timber with a vertically placed securing member, each upright timber member having a face which faces the face of the other upright timber member and a vertical mortise formed in the face;

c) a plurality of elongated, horizontal timber members stacked vertically in alignment between the upright timber members, each horizontal timber member having formed in each of its ends a mortise which faces and aligns vertically with the mortise of one of said upright timber members when said horizontal timber member is stacked;

d) a spline inserted between each end of each one of said horizontal timber members and said upright timber members, said spline occupying said aligned mortises; and e) a first tie beam extending between the tops of the first and second upright timber members, the first tie beam having distal ends, each distal end comprising a notch to provide a half-lap joint with an adjacent tie beam, the distal ends of the first tie beam being positioned above the first and second upright timber members, wherein said horizontal members are free to settle or shrink in a vertical direction beneath said first tie beam, and said tie beam is retained at a substantially constant vertical position by said first and second upright timber members.

2. The wall construction as claimed in claim 1, wherein the tie beam is identical to the sill timber.

3. A wall construction comprising two wall sections as described in claim 1, said wall construction further comprising a third upright timber member, a second sill member, and a second tie beam, said second upright timber member having two faces and two mortises, said third upright timber member being spaced apart from said second upright timber member and extending upwardly from said second sill timber, said third upright timber member having a face which faces the second face of the second upright timber member and a vertical mortise formed in the face, and pluralities of horizontal timber members stacked vertically in alignment between said first and second upright timber members and between said second and third upright timber members, wherein said first and second sill members are joined together with a half-lap joint secured with the vertically placed securing member and said second upright timber member extends upwardly from said joint, and wherein said second tie beam extends between the tops of said second and third upright timber members, said first and second tie beams are joined together with a half-lap joint, and the half-lap joint joining the first and second tie beams sits atop of said second upright timber member.

4. A building comprising a combination of a plurality of wall constructions as claimed in claim 3, wherein each wall panel has the same dimensions.

5. The wall construction as claimed in claim 3 wherein said first and second sill timbers are longitudinally aligned and said second upright timber member has opposing faces having vertical mortises.

6. The wall construction as claimed in claim 3 wherein said first and second sill timbers are joined at a right angle and said second upright timber member has adjacent faces having vertical mortises.

7. A building comprising a combination of a plurality of wall constructions as claimed in claim 3.

8. The wall construction as claimed in claim 3 wherein said first and second tie beams are longitudinally aligned and said second upright timber member has vertical mortises formed on opposing faces.

9. The wall construction as claimed in claim 3 wherein said first and second tie beams are joined at a right angle and said second upright timber member has vertical mortises formed on adjacent faces.

10. The wall construction as claimed in claim 3 further comprising one or more wooden top-plates fixed to the tops of the tie beams such that they overlap the joint of the tie beams.

11. The wall construction as claimed in claim 3 wherein the vertically placed securing member comprises a wooden dowel passing through said first and second sill timbers at said half-lap joint and extending upwardly to be engaged in a cavity formed in the bottom of said second upright timber member.

12. The wall construction as claimed in claim 11 further comprising a wooden dowel passing through said first and second tie beams at said half-lap joint and extending downwardly to be engaged in a cavity formed in the top of said second upright timber member.

13. The wall construction as claimed in claim 3 wherein the vertically placed securing member comprises a metal pin passing through said first and second sill timbers at said half-lap joint and extending upwardly to be engaged in a cavity formed in the bottom of said second upright timber member.

14. The wall construction as claimed in claim 11 further comprising a metal pin passing through said first and second tie beams at said half-lap joint and extending downwardly to be engaged in a cavity formed in the top of said second upright timber member.

15. The wall section as claimed in claim 1 wherein at least one of said splines extends past the bottom edge of a horizontal timber member to occupy at least a portion of the mortise of the horizontal timber member below it.

16. The wall section as claimed in claim 1 wherein said mortises of said vertical timber members are formed in the center of the faces of the vertical timber members and the mortises of said horizontal members are formed in the center of the ends of the horizontal members.

17. The wall section as claimed in claim 1 wherein the horizontal timber members are logs.

18. A wall section as claimed in claim 1 wherein the upper and lower surfaces of one or more of the horizontal timber members are flat.

19. A wall construction as claimed in claim 3 wherein at least one weather insulating strip is located between adjacent upper and lower surfaces of adjacent horizontal timber members.

20. A wall construction as claimed in claim 3 wherein the elongated edges and the vertical edges of the horizontal timber members are chamfered, to receive a continuous bead of caulking or chinking sealant.

21. A wall construction as claimed in claim 20 wherein the vertical edges of the upright timber members are also chamfered to receive a continuous bead of caulking or chinking sealant.

22. A wall section as claimed in claim 1 wherein one or more of said horizontal timber members does not extend from said first to said second upright timber member to accommodate the addition of a window within the wall section.

23. A method of constructing a building comprising:

a) providing a foundation;

b) on said foundation, providing a plurality of sill timbers, each sill timber having an aperture for receiving a vertically placed securing member formed through each of its distal ends, each of the distal ends comprising a notch to provide a half-lap joint with an adjacent sill timber;

c) on said sill timbers providing a plurality of spaced apart vertical timber members and engaging a vertically placed securing member between a half-lap joint of two of the sill members and a cavity formed in the bottom of a corresponding one of the vertical timber members, each of said vertical timber members having two faces with vertical mortises;

d) placing a plurality of lower-most horizontal timber members on said sill timbers, each between adjacent vertical timber members, the horizontal timber members extending longitudinally therebetween, said horizontal timber members having a vertical mortise formed in each one of its two end faces which align with a vertical mortise in a vertical member when said horizontal timber member is in place, forming aligned mortises;

e) inserting a spline into each one of said aligned mortises;

f) stacking a plurality of horizontal timber members between adjacent vertical timber members and inserting splines in each set of aligned mortises until a predetermined wall height is obtained;

g) providing a plurality of tie beams having distal ends, each distal end comprising a notch to provide a half-lap joint with an adjacent tie beam and each distal end having an aperture formed therethrough;

h) placing one of said tie beams between each pair of adjacent vertical timber members and forming a half-lap joint between each pair of adjacent tie beams above the corresponding vertical timber member, each of the distal ends of the tie beam being positioned above a respective one of the pair of adjacent vertical timber members; and i) allowing the horizontal members to settle or shrink in a vertical direction beneath the tie beams while the vertical timber members retain the tie beams at a substantially constant vertical position.

* * * * *